US009359110B2

(12) United States Patent
Dudik

(10) Patent No.: US 9,359,110 B2
(45) Date of Patent: Jun. 7, 2016

(54) CLIP AND POUR

(71) Applicant: Jill Dudik, Canfield, OH (US)

(72) Inventor: Jill Dudik, Canfield, OH (US)

( * ) Notice: Subject to any disclaimer, the term of this patent is extended or adjusted under 35 U.S.C. 154(b) by 5 days.

(21) Appl. No.: 14/087,298

(22) Filed: Nov. 22, 2013

(65) Prior Publication Data

US 2014/0305972 A1 Oct. 16, 2014

Related U.S. Application Data

(60) Provisional application No. 61/811,969, filed on Apr. 15, 2013.

(51) Int. Cl.
*B65D 5/72* (2006.01)
*B65D 25/40* (2006.01)

(52) U.S. Cl.
CPC ..... *B65D 25/40* (2013.01)

(58) Field of Classification Search
CPC ..... B44D 3/128; A47G 19/12; A47G 19/145; B67D 3/0051; B67D 3/0061; B67D 7/005; B65D 25/40; B65D 5/74; B65D 5/746; B65D 25/42; B65D 25/48; B65D 47/06; B65D 75/5861; B65D 75/5872; B65D 75/5877; B65D 75/5883; B65D 77/068; B65D 47/40
USPC ..... 222/566, 567, 569, 570, 571, 574
See application file for complete search history.

(56) References Cited

U.S. PATENT DOCUMENTS 200,976 A * 3/1878 Campbell ..... 210/469
2,168,609 A * 8/1939 O'Brien et al. ..... 222/498
2,471,189 A * 5/1949 Bartels ..... 222/189.07
2,580,811 A 1/1952 Martinsen
2,684,793 A * 7/1954 Warrick ..... 222/567
2,765,966 A * 10/1956 Davis ..... 222/570
2,783,924 A * 3/1957 Hayes ..... 222/569
3,272,407 A * 9/1966 Ottestad ..... 222/569
3,625,654 A * 12/1971 Van Duyne ..... A61B 10/007 206/813
3,708,092 A 1/1973 Frazer
3,863,819 A * 2/1975 Storm ..... 222/569
3,987,943 A 10/1976 Richmond, Jr.
4,111,340 A 9/1978 Greenhow et al.
4,299,340 A * 11/1981 Hrytzak ..... 222/189.07
5,022,567 A * 6/1991 Frazer ..... 222/475
5,195,662 A * 3/1993 Neff ..... 222/108
5,579,963 A * 12/1996 Murthi ..... 222/570
D382,801 S * 8/1997 Samson ..... D9/435
5,758,804 A 6/1998 Wirth
D407,642 S 4/1999 Wirth
D407,643 S 4/1999 Wirth
6,983,869 B1 * 1/2006 Stevens ..... B65D 47/127 220/701
7,275,666 B2 * 10/2007 Rukavina et al. ..... 222/570
2004/0065698 A1 * 4/2004 Braunstein et al. ..... 222/570
2005/0178805 A1 * 8/2005 Abrahams ..... 222/570
2007/0017934 A1 * 1/2007 PaPasodero ..... 222/189.07

(Continued)

*Primary Examiner* — Patrick M Buechner
(74) *Attorney, Agent, or Firm* — Buckingham, Doolittle & Burroughs, LLC

(57) ABSTRACT

A pouring device is shown that affords convenience, practicality, and safety when pouring liquids or food from containers without a spout. The pouring device contains a spout cap component, a lip portion on the spout cap component, and an attachment component for removably securing the spout cap component to a container for pouring. The attachment component is typically a clip which would be manufactured as an integral piece with the spout cap component. The devices can be manufactured in different sizes and stacked together for storage.

7 Claims, 3 Drawing Sheets

(56) References Cited

U.S. PATENT DOCUMENTS

2007/0023463 A1* 2/2007 MacClarence ..... 222/567
2008/0017540 A1* 1/2008 Sawhney ..... G01F 19/00
206/514
2010/0243723 A1* 9/2010 Partington ..... G01F 19/00
229/406
2014/0305972 A1* 10/2014 Dudik ..... 222/570
2014/0319187 A1* 10/2014 McGee ..... 222/570

* cited by examiner

CLIP AND POUR

CROSS-REFERENCE

This application claims priority from Provisional Patent Application Ser. No. 61/811,969 filed Apr. 15, 2013.

BACKGROUND

When pouring liquid or food from a solid container without a spout, the liquid or food can run down the side of the container and spill onto the countertop, table, or floor. Not only is this messy, but it is also wasteful. To prevent this from happening, some individuals may spoon or ladle the liquid or food out in small portions, but this can be time consuming, and users may burn themselves with the hot liquid or food and/or cross contaminate the same. An effective solution is necessary.

The present invention provides a convenient way to pour liquid or food from any container or cooking vessel, and prevents the contents from running down the side of the container and making a mess. The pouring device protects users from burning themselves with hot liquid or food, and saves time and frustration when transferring foods or liquids. The device hooks onto the side of any container, including bowls, mugs, and pots and pans, and is easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a pouring device that affords convenience, practicality, and safety when pouring liquids or food from containers or vessels without a spout. The pouring device comprises a spout cap component, a lip portion on the spout cap component, and an attachment component for removably securing the spout cap component to a container or vessel for pouring. The spout cap component comprises an end wall and opposing side walls depending therefrom. Furthermore, the spout cap component comprises an extending lip portion, wherein the lip portion forms a spout tapering inwardly from the opposing side walls of the spout cap component. The attachment component is typically a clip which would extend out from the end wall of the spout cap component and then curve downward toward the bottom of the device. The clip would be manufactured as an integral piece with the spout cap component.

In a preferred embodiment, the lip portion tapers downwardly and terminates in a tip edge above a plane of an upper portion of the end wall of the spout cap component. The devices can be manufactured in different sizes depending on the wants and needs of a user, with larger devices being able to handle larger volume of liquids and smaller devices being able to handle a smaller volume of liquids. Further, the different-sized pouring devices can be stacked together, such that the devices nest in one another, similar to measuring cups, for storage.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
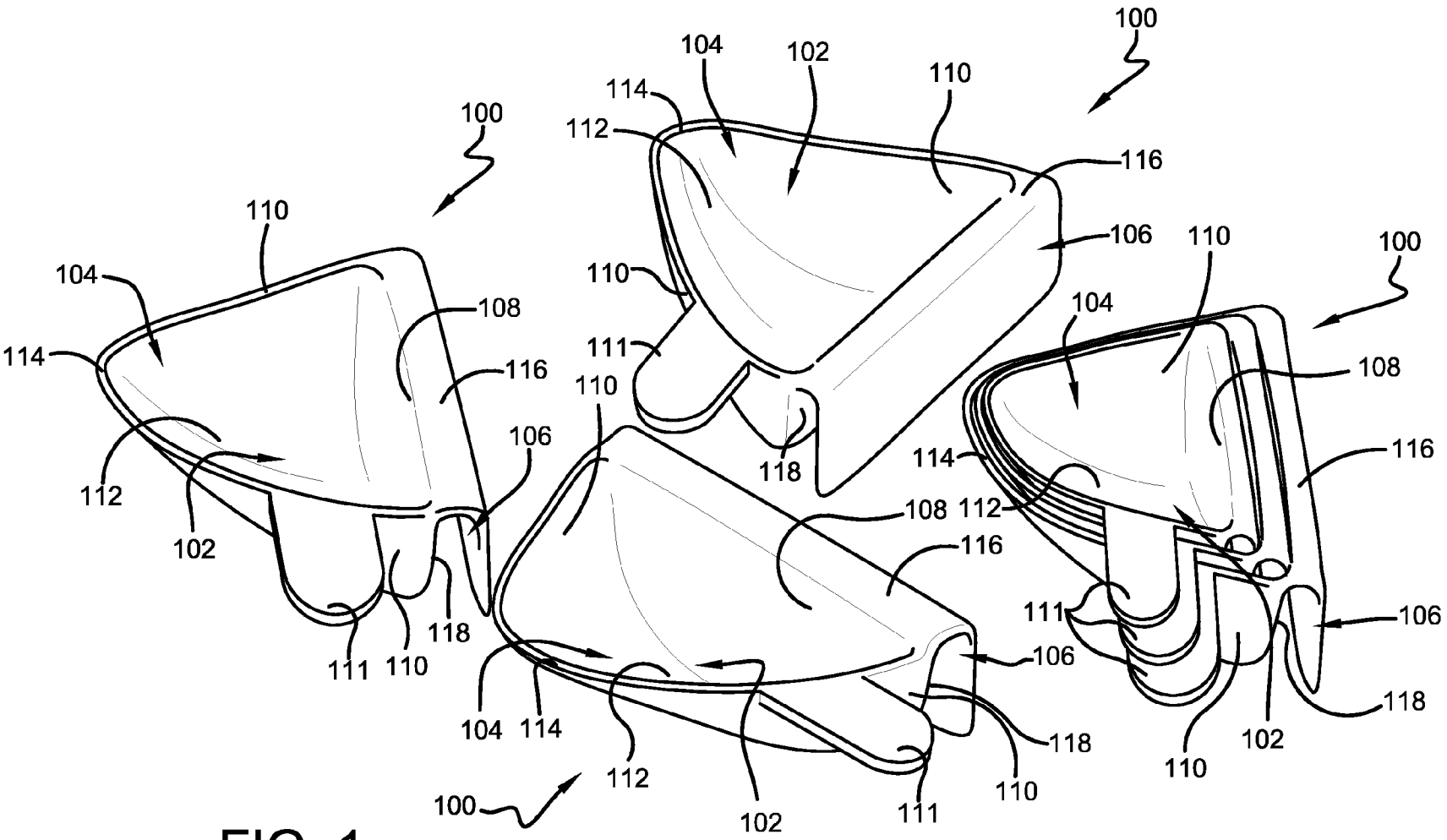
FIG. 1 illustrates a perspective view of the pouring device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention provides a convenient way to pour liquid or food from any container or cooking vessel, and prevents the contents from running down the side of the container and making a mess. The pouring device protects users from burning themselves with hot liquid or food, and saves time and frustration when transferring foods or liquids. The device removably attaches to the side of any container, including bowls, mugs, and pots and pans, and is easy to use.

The disclosed pouring device comprises a spout cap component, a lip portion on the spout cap component, and an attachment component for removably securing the spout cap component to a container for pouring. The spout cap component comprises an end wall, opposing side walls depending therefrom, and an extending lip portion. The lip portion forms a spout tapering inwardly from the opposing side walls of the spout cap component. The attachment component is typically a clip which would extend out from the end wall of the spout cap component and then curve downward toward the bottom of the device. The clip would be manufactured as an integral piece with the spout cap component. The devices can be manufactured in different sizes and stacked together for storage.

Referring initially to the drawings, FIG. 1 illustrates the pouring device 100 that affords convenience, practicality, and safety when pouring liquids or food from containers or vessels without a spout. The pouring device 100 comprises a spout cap component 102, an extending lip portion 104 on the spout cap component 102, and an attachment component 106 for securing the spout cap component 102 to a container or vessel for pouring (as shown in FIG. 1).

The spout cap component 102 comprises an end wall 108 and opposing side walls 110 depending therefrom. Typically, the spout cap component 102 can be any suitable shape as is known in the art without affecting the overall concept of the invention, as long as liquid can be poured from it. The spout cap component 102 would generally be constructed of metal, such as aluminum, or heat resistant and food grade plastics, such as polyvinyl chloride (PVC), acrylonitrile butadiene styrene (ABS), polycarbonate (PC), etc., composite polymers, rubber, or recycled material, though any other suitable material may be used to manufacture the spout cap component 102 as is known in the art without affecting the overall concept of the invention provided that the same is heat resistant to temperatures of 100 degrees Celsius or 250 degrees Fahrenheit to 500 degrees Celsius or 1000 degrees Fahrenheit although; depending on the material used, it may be higher.

The spout cap component 102 can also comprise a variety of colors and designs to suit user and manufacturing preference. Furthermore, the shape and size of the spout cap component 102 may vary greatly depending on the wants and needs of a user, and the spout cap component 102 can be manufactured in various sizes to handle larger and smaller amounts of liquid and food.

Furthermore, the spout cap component 102 comprises an extending lip portion 104, wherein the lip portion 104 forms a spout 112 tapering inwardly from the opposing side walls 110 of the spout cap component 102. Typically, the lip portion 104 tapers downwardly and terminates in a tip edge 114 above a plane of an upper portion 116 of the end wall 108 of the spout cap component 102, such that liquid in the spout 112 would flow back into the container from which it is being poured and would not remain in the spout 112 or spill out of the spout 112. The spouts 112 can be manufactured in different sizes depending on the wants and needs of a user, with larger spouts 112 being able to handle larger volume of liquids and smaller spouts 112 being able to handle a smaller volume of liquids.

The spout cap component 102 further comprises a tab 111 secured to an outside edge of at least one of the side walls of the spout cap component 102 that provides a place for a user to grip the pouring device 100 and remove the pouring device 100 with ease and safety. The tab 111 can be any suitable size as long as it allows a user to comfortably grip the device 100, and can be secured to any suitable position on the spout cap component 102.

The pouring device 100 further comprises an attachment component 106 secured to an outer surface 118 of the end wall 108 for removably securing the spout cap component 102 to the container for pouring. The attachment component 106 can be any suitable attaching means as is known in the art, such as a clip, a hinge, a snap component, fasteners, etc., without affecting the overall concept of the invention, provided that the same can be quickly and easily attached/detached from the container wall. The clip could extend out from the end wall 108 of the spout cap component 102 and then curve downward toward the bottom of the device 100, and the clip could be a separate piece secured to the end wall 108 or manufactured as an integral piece with the spout cap component 102. The hinge could be tightened around the edge of the container or vessel, to removably secure the spout cap component 102 to the container or vessel. The hinge could be manufactured as a separate piece or as an integral piece with the spout cap component 102. The snap component or fasteners would also act to removably secure the spout cap component 102 to the container or vessel. The attachment component 106 would typically be manufactured of the same material as the spout cap component 102, but can be manufactured of any suitable material as is known in the art as long as the material is flexible enough to allow the attachment component 106 to form itself to the cooking container.

The attachment component 106 allows the spout cap component 102 to be removably secured to a container or cooking vessel for pouring, and then removed when not in use. For example, as shown in FIGS. 2-5 the spout cap component 102 can be secured to a drinking mug, a cooking pan, and a bowl, or any other suitable cooking container or vessel. Further, the pouring device 100 can be manufactured in different sizes depending on the wants and needs of a user, and the different-sized pouring devices 100 can be stacked together, such that the devices 100 nest in one another, similar to measuring cups, for storage.

Figure 2:
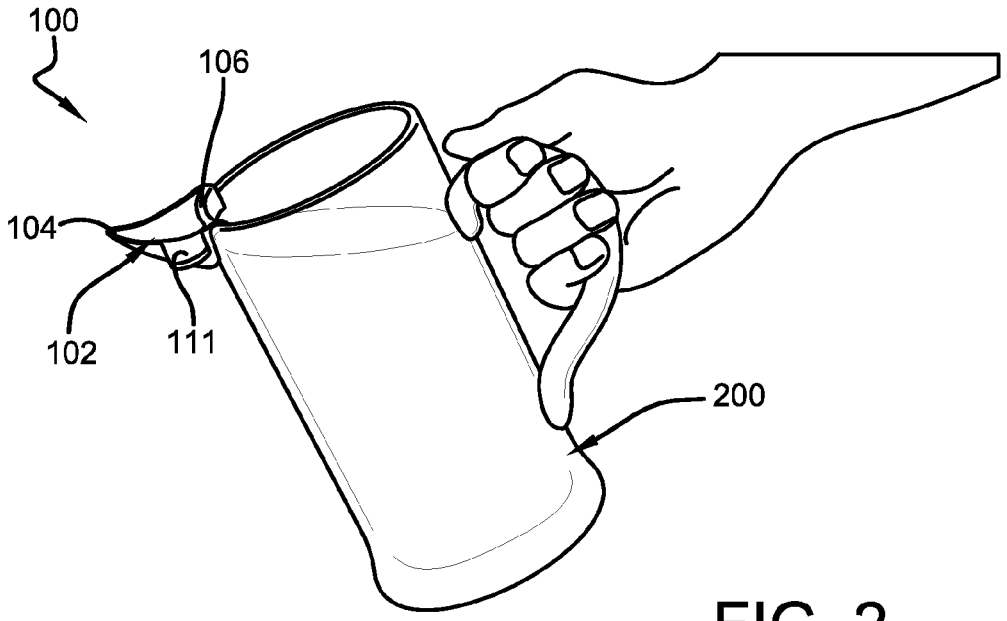
FIG. 2 illustrates a perspective view of the pouring device in use with a drinking mug in accordance with the disclosed architecture.
Figure 3:
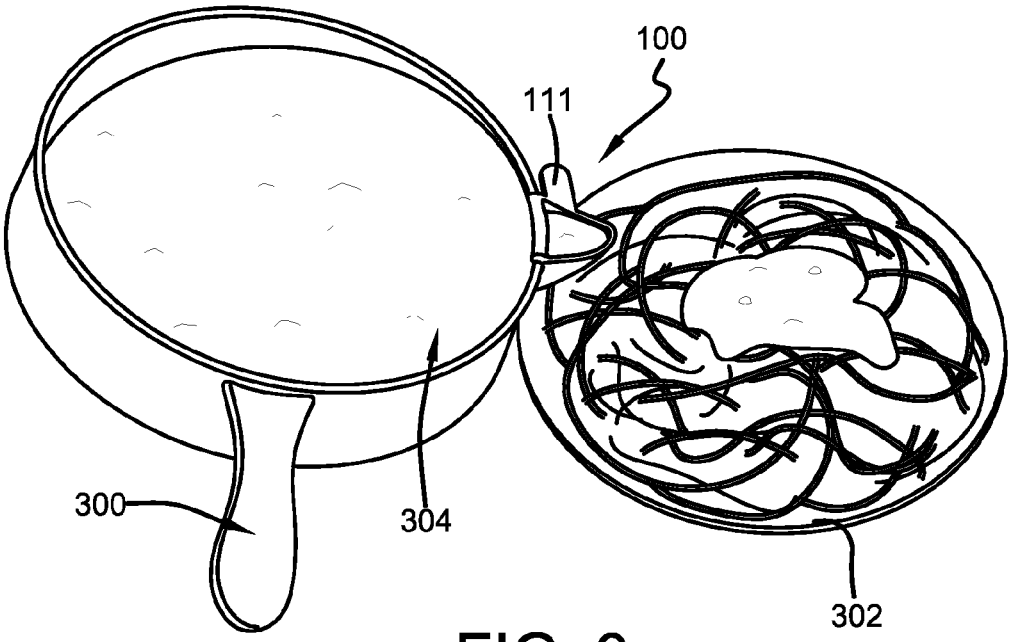
FIG. 3 illustrates a perspective view of the pouring device in use with a cooking pan in accordance with the disclosed architecture.
Figure 4:
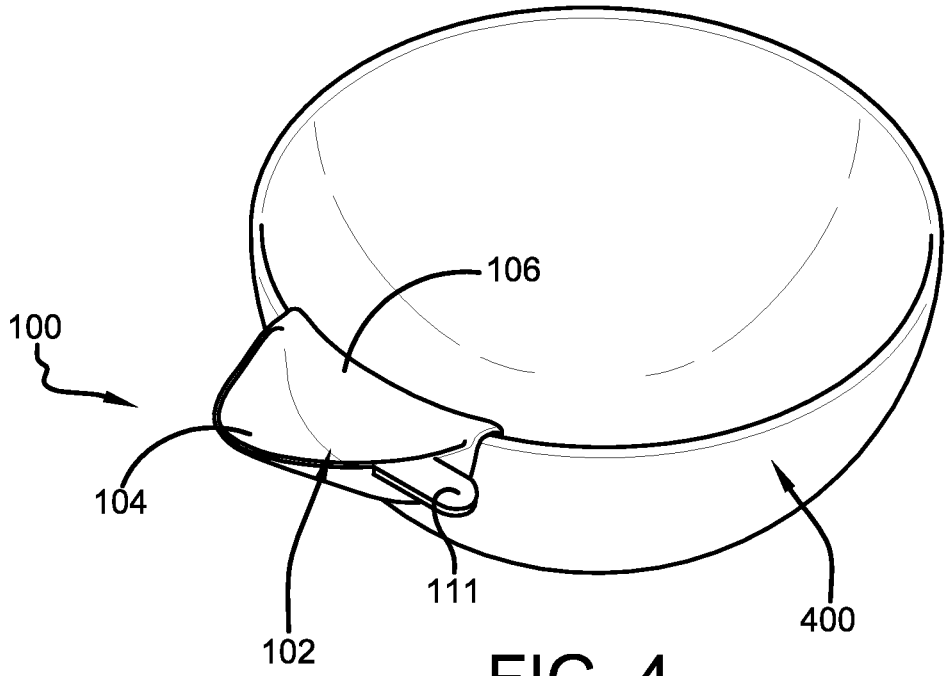
FIG. 4 illustrates a perspective view of the pouring device in use with a bowl in accordance with the disclosed architecture.
Figure 5:
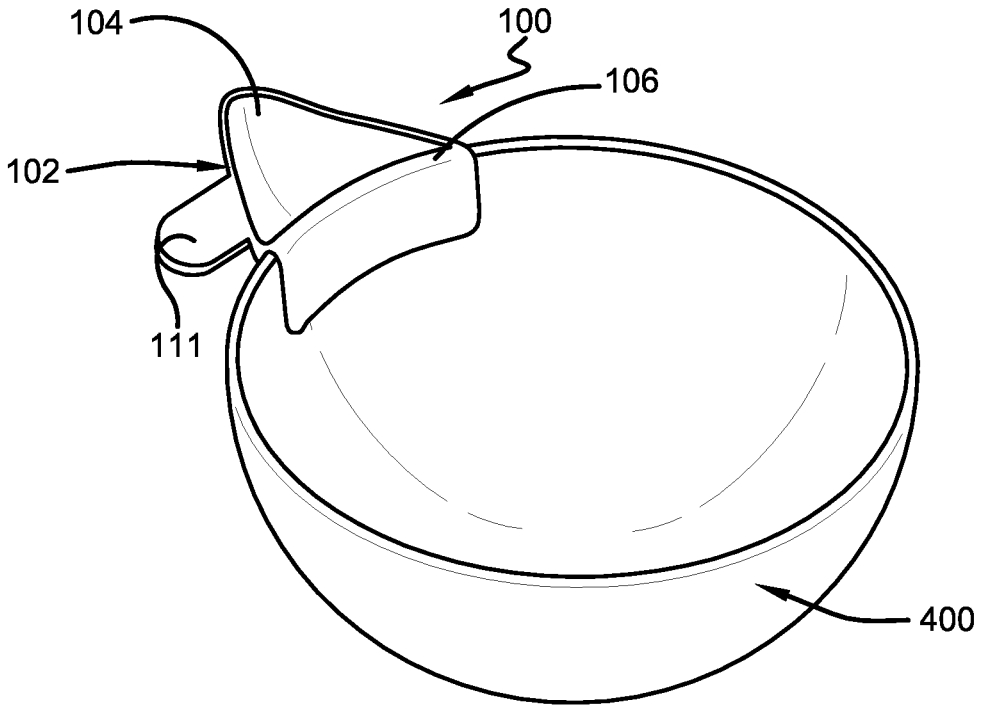
FIG. 5 illustrates a perspective view of the pouring device in use with a bowl in accordance with the disclosed architecture.

FIGS. 2-5 illustrate the pouring device 100 in use secured to various cooking containers and vessels. For example, FIG. 2 shows the pouring device 100 secured to a drinking mug 200, FIG. 3 shows the pouring device 100 secured to a cooking pan 300 and food 304 being poured onto a plate 302 from the cooking pan 300, and FIGS. 4-5 shows the pouring device 100 secured to a bowl 400. As stated supra, the pouring device 100 comprises a spout cap component 102, a lip portion 104 on the spout cap component 102, and an attachment component 106 for removably securing the spout cap component 102 to a container or vessel for pouring. The spout cap component 102 comprises an end wall 108 and opposing side walls 110 depending therefrom. Furthermore, the spout cap component 102 comprises an extending lip portion 104, wherein the lip portion 104 forms a spout 112 tapering inwardly from the opposing side walls 110 of the spout cap component 102. The spout cap component 102 can also comprise a tab 111 secured to an outside edge of the spout cap component 102 that provides a place for a user to grip the pouring device 100 and remove the pouring device 100 with ease and safety. The attachment component 106 is typically a clip which would extend out from the end wall 108 of the spout cap component 102 and then curve downward toward the bottom of the device 100. The clip would be manufactured as an integral piece with the spout cap component 102.

Furthermore, the lip portion 104 tapers downwardly and terminates in a tip edge 114 above a plane of an upper portion 116 of the end wall 108 of the spout cap component 102. The devices 100 can be manufactured in different sizes depending on the wants and needs of a user, with larger devices being able to handle larger volume of liquids and smaller devices being able to handle a smaller volume of liquids. Further, the different-sized pouring devices 100 can be stacked together, such that the devices 100 nest in one another, similar to measuring cups, for storage.

In operation, a user (not shown) would choose the size and/or color of the pouring device 100 that meets their needs and/or wants, such as a larger device for a larger volume of liquid and a smaller device for a smaller volume of liquid. The user would then slide the pouring device 100 onto the edge of the container or vessel, securing the device 100 in place by pushing down toward the bottom of the container or vessel. Once secure, the user can then grasp the container or vessel and pour the liquid or food from the container or vessel to another container, plate, vessel, sink, etc. After the liquid or food has been poured, the user can then remove the device 100 by grasping the exterior of the device 100 and lifting upward away from the container or vessel. The pouring device 100 can then be wiped clean and stored. Thus, the pouring device 100 protects users from burning themselves with hot liquid or food, and saves time and frustration when transferring foods or liquids.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pouring device for use with a container comprising:

a spout cap component comprising an end wall and opposing sidewalls depending therefrom, wherein the end wall comprises an outside surface for engaging an outside of the container and an upper portion forming a back rim for the spout cap component; and a laterally extending lip portion on the spout cap component, wherein the lip portion forms a spout tapering inwardly from the opposing sidewalls so that the spout cap component is teardrop shaped; and a single clip that secures over an edge of and into the container for securing the spout cap component to the container for pouring, the clip comprising a transition portion extending laterally out of and an entire length of the upper portion of the end wall of the spout cap component for bridging a rim of the container and a container engaging portion extending downwardly out of the transition portion for inserting into the container, the container engaging portion comprising an inside surface for resting flush against an inside wall of the container while the outside surface of the end wall of the spout cap engages the outside of the container; wherein the clip would extend out from the end wall of the spout cap component and then curve downward toward a bottom of the device, and would be manufactured as an integral component with the spout cap component, and wherein the clip is configured to conform to the shape of the container; and a tab secured to an outside edge of at least one of the sidewalls of the spout cap component; and wherein the lip portion terminates in a tip edge above a plane of an upper portion of the end wall of the spout cap component, and the upper portion of the end wall extends above a level of an edge of the container.

2. The pouring device of claim 1, wherein the spout cap component is comprised of food grade and heat resistant plastic.

3. The pouring device of claim 1, wherein the spout cap component is comprised of rubber.

4. The pouring device of claim 1, wherein the container is a drinking mug.

5. The pouring device of claim 1, wherein the container is a bowl.

6. The pouring device of claim 1, wherein the container is a cooking pan.

7. A pouring device for use with a container comprising:

a plurality of stackable elements of different sizes, each element comprising:

a spout cap component comprising an end wall and opposing sidewalls depending therefrom, wherein the end wall comprises an outside surface for engaging an outside of the container and an upper portion forming a back rim for the spout cap component; and a laterally extending lip portion on the spout cap component, wherein the lip portion forms a spout tapering inwardly from the opposing sidewalls so that the spout cap component is teardrop shaped; and a single clip that secures over an edge of and into the container for securing the spout cap component to the container for pouring, the clip comprising a transition portion extending laterally out of and an entire length of the upper portion of the end wall of the spout cap component for bridging a rim of the container and a container engaging portion extending downwardly out of the transition portion for inserting into the container, the container engaging portion comprising an inside surface for resting flush against an inside wall of the container while the outside surface of the end wall of the spout cap engages the outside of the container; wherein the clip would extend out from the end wall of the spout cap component and then curve downward toward a bottom of the device, and would be manufactured as an integral component with the spout cap component, and wherein the clip is configured to conform to the shape of the container; and a tab secured to an outside edge of at least one of the sidewalls of the spout cap component; and wherein the lip portion terminates in a tip edge above a plane of an upper portion of the end wall of the spout cap component, and the upper portion of the end wall extends above a level of an edge of the container.

* * * * *